US006651367B1

(12) United States Patent
Barragan

(10) Patent No.: US 6,651,367 B1
(45) Date of Patent: Nov. 25, 2003

(54) EMERGENCY MESSAGE SIGN DEVICE FOR VEHICLES

(76) Inventor: Demetrio Barragan, 2476 Impala Dr., Culver City, CA (US) 92008

( * ) Notice: Subject to any disclaimer, the term of this patent is extended or adjusted under 35 U.S.C. 154(b) by 149 days.

(21) Appl. No.: 09/759,070

(22) Filed: Jan. 12, 2001

(51) Int. Cl.[7] ..... G09F 7/00; G09F 7/18

(52) U.S. Cl. ..... 40/610; 40/611.05; 40/611.09; 116/63 P

(58) Field of Search ..... 40/600, 610, 612; D20/17; 116/63 P, 63 T, 63 C; 248/453, 460; 281/33

(56) References Cited

U.S. PATENT DOCUMENTS

| | | | | | |
|---|---|---|---|---|---|
| 1,368,859 | A | * | 2/1921 | Styll | 281/33 |
| 2,625,408 | A | * | 1/1953 | Hirsch | 281/33 |
| 2,783,061 | A | * | 2/1957 | Owen | 281/33 |
| 3,322,093 | A | * | 5/1967 | Goland et al. | 40/600 |
| 3,936,967 | A | * | 2/1976 | Davis | 40/591 |
| 4,062,139 | A | * | 12/1977 | Klosel | 40/600 |
| 4,663,874 | A | | 5/1987 | Sano et al. | |
| 4,888,893 | A | | 12/1989 | Jones | |
| 4,995,186 | A | | 2/1991 | Collie | |
| 5,005,306 | A | | 4/1991 | Kinstler | |
| 5,029,797 | A | * | 7/1991 | Levorchick et al. | 248/459 |
| 5,156,274 | A | | 10/1992 | Williams, Jr. et al. | |
| D336,932 | S | | 6/1993 | Davis et al. | |
| 5,413,305 | A | * | 5/1995 | Leeb | 248/460 |
| 5,784,814 | A | * | 7/1998 | Capehart | 40/600 |

FOREIGN PATENT DOCUMENTS

| | | | | |
|---|---|---|---|---|
| GB | 2 231 997 A | * | 11/1990 | 40/610 |

* cited by examiner

*Primary Examiner*—Cassandra H. Davis

(57) ABSTRACT

An emergency message sign device for vehicles for drawing attention to a disabled vehicle to receive assistance. The device includes a sign holder for supporting interchangeable signs. The sign holder comprises a front panel having upper and lower ends, and a rear panel having upper and lower ends. The upper ends of the panels are pivotally connected together for permitting pivot movement of the front panel with respect to the rear panel, so that the front and rear panels are pivotally movable between a collapsed position and an expanded position. The sign holder includes a pocket being formed on a front of the front panel. The pocket has a closed end positioned adjacent the lower end of the front panel and an opening located intermediate the upper and lower ends of the front panel. A plurality of signs is removably insertable into the pocket. Each of the signs has a front surface with indicia marked thereon.

14 Claims, 2 Drawing Sheets

EMERGENCY MESSAGE SIGN DEVICE FOR VEHICLES

BACKGROUND OF THE INVENTION

1. Field of the Invention

The present invention relates to emergency signaling devices and more particularly pertains to a new emergency message sign device for vehicles for drawing attention to a disabled vehicle to receive assistance.

2. Description of the Prior Art

The use of emergency signaling devices is known in the prior art. More specifically, emergency signaling devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art emergency signaling devices include U.S. Pat. No. 5,156,274 to Williams, Jr. et al.; U.S. Pat. No. 4,663,874 to Sano et al.; U.S. Pat. No. Des. 336,932 to Davis et al.; U.S. Pat. No. 4,888,893 to Jones; U.S. Pat. No. 4,995,186 to Collie; and U.S. Pat. No. 5,005,306 to Kinstler.

While these devices fulfill their respective, particular objectives and requirements, the aforementioned patents do not disclose a new emergency message sign device for vehicles. The sign device includes a sign holder for supporting interchangeable signs. The sign holder comprises a front panel having upper and lower ends, and a rear panel having upper and lower ends. The upper ends of the panels are pivotally connected together for permitting pivot movement of the front panel with respect to the rear panel, so that the front and rear panels are pivotally movable between a collapsed position and an expanded position. The sign holder includes a pocket being formed on a front of the front panel. The pocket has a closed end positioned adjacent the lower end of the front panel and an opening located intermediate the upper and lower ends of the front panel. A plurality of signs is removably insertable into the pocket. Each of the signs has a front surface with indicia marked thereon.

In these respects, the emergency message sign device for vehicles according to the present invention substantially departs from the conventional concepts and designs of the prior art, and in so doing provides an apparatus primarily developed for the purpose of drawing attention to a disabled vehicle to receive assistance.

SUMMARY OF THE INVENTION

In view of the foregoing disadvantages inherent in the known types of emergency signaling devices now present in the prior art, the present invention provides a new emergency message sign device for vehicles construction wherein the same can be utilized for drawing attention to a disabled vehicle to receive assistance.

The general purpose of the present invention, which will be described subsequently in greater detail, is to provide a new emergency message sign device for vehicles apparatus and method which has many of the advantages of the emergency signaling devices mentioned heretofore and many novel features that result in a new emergency message sign device for vehicles which is not anticipated, rendered obvious, suggested, or even implied by any of the prior art emergency signaling devices, either alone or in any combination thereof.

To attain this, the present invention generally comprises a sign holder for supporting interchangeable signs. The sign holder comprises a front panel having upper and lower ends, and a rear panel having upper and lower ends. The upper ends of the panels are pivotally connected together for permitting pivot movement of the front panel with respect to the rear panel, so that the front and rear panels are pivotally movable between a collapsed position and an expanded position. The sign holder includes a pocket being formed on a front of the front panel. The pocket has a closed end positioned adjacent the lower end of the front panel and an opening located intermediate the upper and lower ends of the front panel. A plurality of signs is removably insertable into the pocket. Each of the signs has a front surface with indicia marked thereon.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new emergency message sign device for vehicles apparatus and method which has many of the advantages of the emergency signaling devices mentioned heretofore and many novel features that result in a new emergency message sign device for vehicles which is not anticipated, rendered obvious, suggested, or even implied by any of the prior art emergency signaling devices, either alone or in any combination thereof.

It is another object of the present invention to provide a new emergency message sign device for vehicles that may be easily and efficiently manufactured and marketed.

It is a further object of the present invention to provide a new emergency message sign device for vehicles which is of a durable and reliable construction.

An even further object of the present invention is to provide a new emergency message sign device for vehicles which is susceptible of a low cost of manufacture with regard to both materials and labor, and which accordingly is then susceptible of low prices of sale to the consuming public, thereby making such emergency message sign device for vehicles economically available to the buying public.

Still yet another object of the present invention is to provide a new emergency message sign device for vehicles which provides in the apparatuses and methods of the prior art some of the advantages thereof, while simultaneously overcoming some of the disadvantages normally associated therewith.

Still another object of the present invention is to provide a new emergency message sign device for vehicles for drawing attention to a disabled vehicle to receive assistance.

Yet another object of the present invention is to provide a new emergency message sign device for vehicles which includes a sign holder for supporting interchangeable signs. The sign holder comprises a front panel having upper and lower ends, and a rear panel having upper and lower ends. The upper ends of the panels are pivotally connected together for permitting pivot movement of the front panel with respect to the rear panel, so that the front and rear panels are pivotally movable between a collapsed position and an expanded position. The sign holder includes a pocket being formed on a front of the front panel. The pocket has a closed end positioned adjacent the lower end of the front panel and an opening located intermediate the upper and lower ends of the front panel. A plurality of signs is removably insertable into the pocket. Each of the signs has a front surface with indicia marked thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
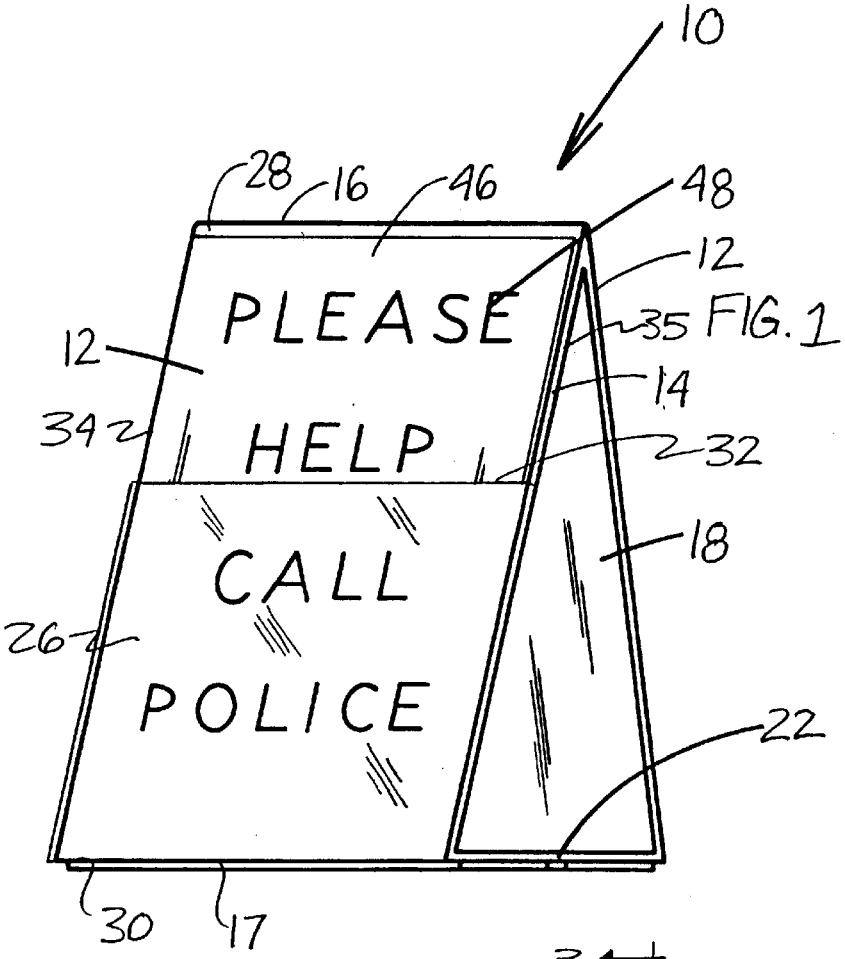
FIG. 1 is a front view of the emergency message sign device for vehicles according to the present invention.
Figure 2:
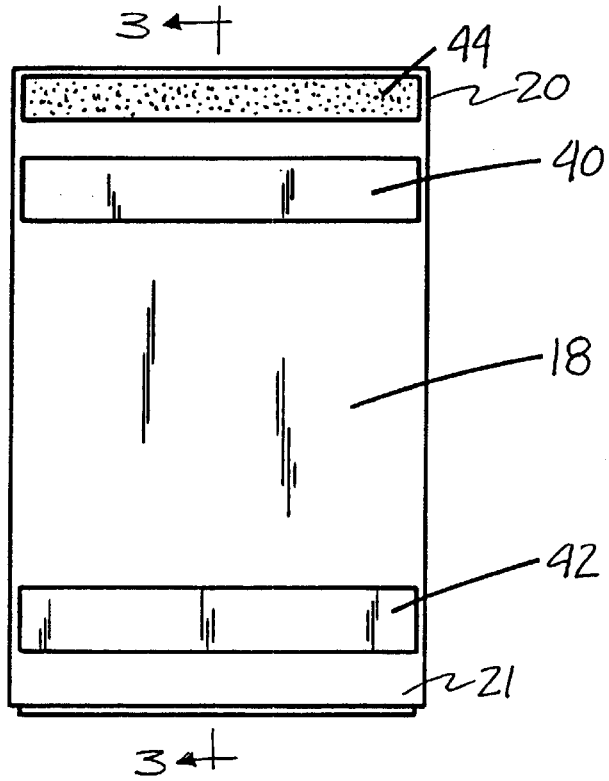
FIG. 2 is a rear view of the present invention.
Figure 3:
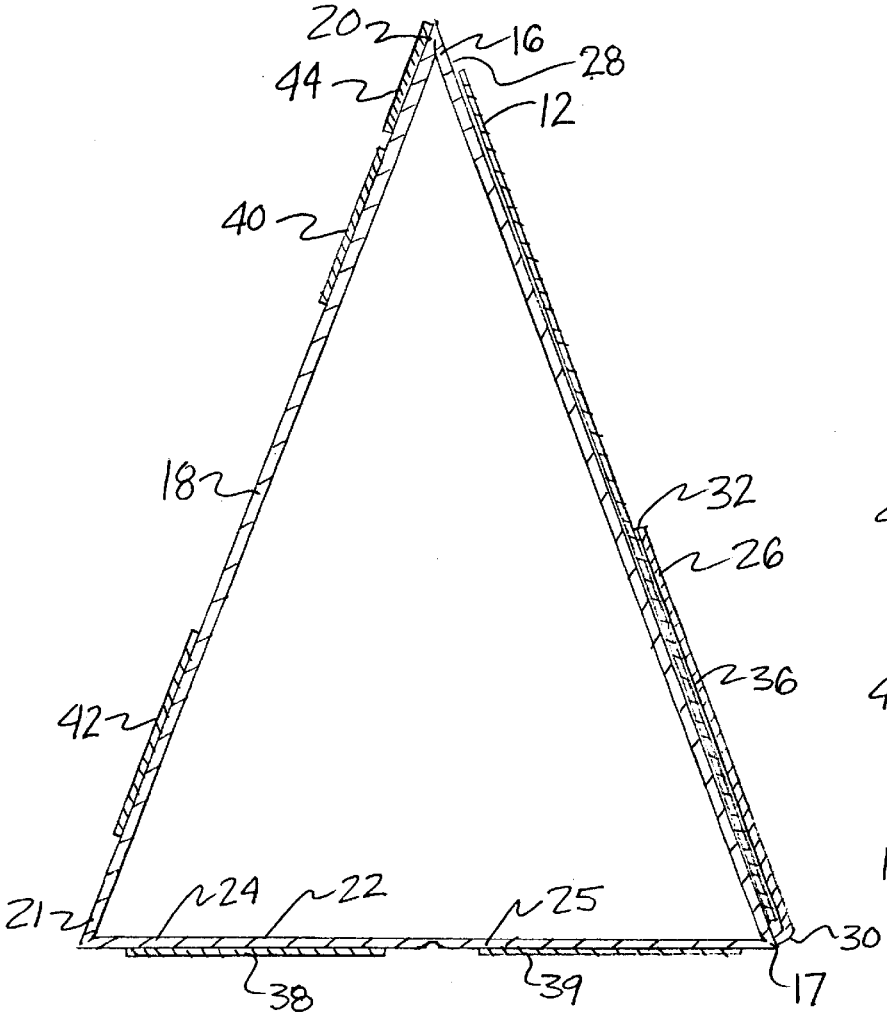
FIG. 3 is a side sectional view of the present invention taken along line 3—3 of FIG. 2 shown in the expanded position.
Figure 4:
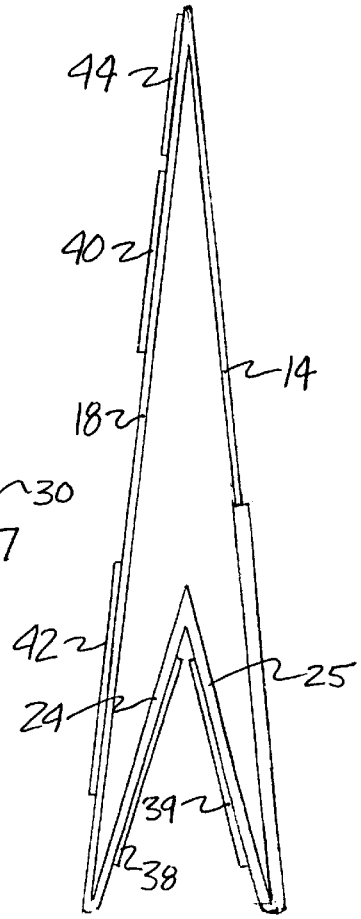
FIG. 4 is a side view of the present invention shown in the collapsed position.

With reference now to the drawings, and in particular to FIGS. 1 through 4 thereof, a new emergency message sign device for vehicles embodying the principles and concepts of the present invention and generally designated by the reference numeral 10 will be described.

As best illustrated in FIGS. 1 through 4, the invention comprises an emergency message sign device for drawing attention to a disabled vehicle to receive assistance. The sign device 10 comprises and a sign holder 11 and a plurality of signs 12.

The sign holder 11 of the invention is provided for supporting the plurality of interchangeable signs. The sign holder includes a front panel 14 that has upper 16 and lower 17 ends, and a rear panel 18 that has upper 20 and lower 21 ends. Preferably, a bottom panel 22 may be provided that links the lower ends 17, 21 of the front 14 and rear 18 panels. The upper ends 16, 18 of the front and rear panels are pivotally connected together for permitting pivot movement of the front panel with respect to the rear panel. The front and rear panels are pivotally movable between a collapsed position (see FIG. 4) and an expanded position (see FIG. 3). The expanded position is characterized by the front and rear panels being oriented at an angle with respect to each other. Illustratively, the panels are separated by an angle of approximately 40 degrees.

The bottom panel 22 may have a first portion 24 and a second portion 25. The first portion 24 is coupled to the front panel 14 and the second portion 25 is coupled to the rear panel. The first and second portions of the bottom panel are pivotally coupled together. The first and second portions of the bottom panel are pivotable into an adjacent condition (see FIG. 4) when the first and rear panels are in the collapsed condition. The first and second portions of the bottom panel are pivoted into a substantially planar condition (see FIG. 3) when the front and rear panels are in the expanded condition.

A pocket 26 is provided for holding at least one of the plurality of signs. The pocket is formed on a front 28 of the front panel. The pocket has a closed end 30 positioned adjacent the lower end of the front panel, and has an opening 32 located intermediate the upper and lower ends of the front panel. The opening extends from a first side edge 34 of the front panel to a second side edge 35 of the front panel. The pocket is preferably formed by a pocket panel 36 formed of a substantially transparent material and the front of the front panel. Significantly, the transparent nature of the pocket panel permits indicia marked on the signs to be seen through the panel, thus increasing the area on the signs on which the message can be marked.

Preferably, a magnetic member 38 is mounted on at least one of the portions of the bottom panel for mounting the sign holder to a substantially horizontal surface and maintaining the front panel in a generally vertical orientation. The magnetic member 38 is coupled to an outer surface of the at least one portion of the bottom panel. In one embodiment of the invention, a magnetic member 38, 39 is coupled to each of the portions of the bottom panel to hold each of the portions adjacent to the surface.

Optionally, a magnetic member 40 may be coupled to the rear panel, and may be mounted on an outer surface of the rear panel. As a further option, a pair of magnetic members 40, 42 may be coupled to the rear panel. The pair of magnetic members 40, 42 may be spaced from each other such that a first one of the magnetic members is located toward the upper end of the rear panel and a second one of the magnetic members is located toward the lower end of the rear panel.

A hook and loop fastener component 44 may be coupled to an outer surface of the rear panel for fastening the rear panel to another hook and loop fastener component mounted on a support. This fastener 44 can be highly useful for mounting the sign holder to a generally vertical surface on which a hook and loop fastener component is mounted.

Each of the plurality of signs 12 has a front surface 46 with indicia 48 marked thereon. Each of the signs is adapted to fit in the pocket on the front panel of the sign holder. Preferably, all of the plurality of signs are adapted to fit in the pocket simultaneously for permitting storage of the signs in the pocket. The indicium marked on each of the signs is preferably different from the indicia marked on the other signs. Preferably, the indicia relate to various road side emergencies that a traveler may encounter, and various requests that a stranded traveler might make. Preferably, the signs would be constructed in a bright, easily viewable color. Optionally, the lettering marked on the signs is formed of a reflective material so as to be viewable at night when vehicle headlights strike the sign.

Examples of the indicia marked on the signs may include, but are not limited to, the following: "PLEASE HELP PHONE CALL", "PLEASE HELP NEED GAS", "PLEASE HELP CALL TOW", "I'LL COME BACK", "PLEASE HELP NEED JUMP", "PLEASE HELP CALL 911", "PLEASE HELP FLAT TIRE", "PLEASE HELP I'M LOST", "PLEASE HELP CALL HIGHWAY PATROL", "PLEASE HELP HANDICAP PERSON", "PLEASE TURN RIGHT", "PLEASE TURN RIGHT", "PLEASE TURN RIGHT", "PLEASE HELP CALL FIRE DEPT.", PLEASE HELP CALL POLICE", "PLEASE HELP HIT BY CAR", and "PLEASE HELP CALL PARAMEDICS". In use, the sign holder may be mounted on an exterior surface of the vehicle and the sign with the applicable indicia message being moved to the front of the pocket with the indicia visible.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An emergency message sign device for drawing attention to a disabled vehicle to receive assistance, the sign device comprising:

a sign holder comprising:

a front panel having upper and lower ends, and a rear panel having upper and lower ends, wherein the upper ends of the panels are pivotally connected together for permitting pivot movement of the front panel with respect to the rear panel, the front and rear panels being pivotally movable between a collapsed position and an expanded position;

a pocket being formed on a front of the front panel, the pocket having a closed end positioned adjacent the lower end of the front panel, the pocket having an opening located intermediate the upper and lower ends of the front panel; and a plurality of interchangeable signs removably insertable in the pocket of the sign holder, each of the signs having a front surface with indicia marked thereon;

wherein a pair of said magnetic members are coupled to the rear panel, the pair of magnetic members being spaced such that a first one of the magnetic members is located toward the upper end of the rear panel and a second one of the magnetic members is located toward the lower end of the rear panel.

2. The sign device of claim 1 wherein the sign holder additionally comprises a bottom panel linking the lower ends of the front and rear panels.

3. The sign device of claim 2 wherein the bottom panel has a first portion and a second portion, the first portion being coupled to the front panel and the second portion being coupled to the rear panel, the first and second portions of the bottom panel being pivotally coupled together.

4. The sign device of claim 3 wherein the first and second portions of the bottom panel are pivoted into an adjacent condition when the first and rear panels are in the collapsed condition, and the first and second portions of the bottom panel are pivoted into a substantially planar condition when the front and rear panels are in the expanded condition.

5. The sign device of claim 3 wherein a magnetic member is mounted on at least one of the portions of the bottom panel, the magnetic member being coupled to an outer surface of the at least one portion of the bottom panel.

6. The sign device of claim 3 wherein a magnetic member is coupled to an outer surface of each of the portions of the bottom panel.

7. An emergency message sign device for drawing attention to a disabled vehicle to receive assistance, the sign device comprising:

a sign holder comprising:

a front panel having upper and lower ends, and a rear panel having upper and lower ends, wherein the upper ends of the panels are pivotally connected together for permitting pivot movement of the front panel with respect to the rear panel, the front and rear panels being pivotally movable between a collapsed position and an expanded position;

a pocket being formed on a front of the front panel, the pocket having a closed end positioned adjacent the lower end of the front panel, the pocket having an opening located intermediate the upper and lower ends of the front panel; and a plurality of interchangeable signs removably insertable in the pock of the sign holder, each of the signs having a front surface with indicia marked thereon;

a bottom panel linking the lower ends of the front and rear panels;

wherein the bottom panel has a first portion and a second portion, the first portion being coupled to the front panel and the second portion being coupled to the rear panel, the first and second portions of the bottom panel being pivotally coupled together;

wherein a magnetic member is coupled to an outer surface of each of the portions of the bottom panel; and wherein the magnetic member coupled to the first portion of the bottom panel is oppositely charged with respect to the second portion of the bottom panel such that the magnetic members are attracted to each other.

8. The sign device of claim 2 wherein a magnetic member is mounted on the bottom panel.

9. The sign device of claim 1 wherein the expanded position is characterized by the front and rear panels having an angle of approximately 30 degrees therebetween.

10. The sign device of claim 1 wherein the opening of the pocket extends from a first side edge of the front panel to a second side edge of the front panel.

11. The sign device of claim 1 wherein the pocket comprises a panel formed of a substantially transparent material mounted on the front panel.

12. The sign device of claim 1 wherein a magnetic member is coupled to the rear panel.

13. An emergency message sign device for drawing attention to a disabled vehicle to receive assistance, the sign device comprising:

a sign holder comprising:

a front panel having upper and lower ends, and a rear panel having upper and lower ends, wherein the upper ends of the panels are pivotally connected together for permitting pivot movement of the front panel with respect to the rear panel, the front and rear panels being pivotally movable between a collapsed position and an expanded position;

a pocket being formed on a front of the front panel, the pocket having a closed end positioned adjacent the lower end of the front panel, the pocket having an opening located intermediate the upper and lower ends of the front panel; and a plurality of interchangeable signs removably insertable in the pock of the sign holder, each of the signs having a front surface with indicia marked thereon;

wherein a hook and loop fastener component is coupled to an outer surface of the rear panel for fastening the rear panel to another hook and loop fastener component mounted on a support.

14. An emergency message sign device for drawing attention to a disabled vehicle to receive assistance, the sign device comprising:

a sign holder comprising:

a front panel having upper and lower ends;

a rear panel having upper and lower ends; and a bottom panel linking the lower ends of the front and rear panels;

wherein the upper ends of the panels are pivotally connected together for permitting pivot movement of the front panel with respect to the rear panel, the front and rear panels being pivotally movable between a collapsed position and an expanded position;

wherein the bottom panel has a first portion and a second portion, the first portion being coupled to the front panel and the second portion being coupled to the rear panel, the first and second portions of the bottom panel being pivotally coupled together, the first and second portions of the bottom panel being pivotable into an adjacent condition when the first and rear panels are in the collapsed condition, the first and second portions of the bottom panel being pivoted into a substantially planar condition when the front and rear panels are in the expanded condition;

a pocket being formed on a front of the front panel, the pocket having a closed end positioned adjacent the lower end of the front panel, the pocket having an opening located intermediate the upper and lower ends of the front panel, the opening extending from a first side edge of the front panel to a second side edge of the front panel, wherein the pocket comprises a panel formed of a substantially transparent material mounted on the front panel;

wherein a first magnetic member is mounted on at least one of the portions of the bottom panel, the magnetic member being coupled to an outer surface of the at least one portion of the bottom panel;

wherein a second magnetic member is coupled to the rear panel, the second magnetic member is coupled to an outer surface of the rear panel, wherein a pair of said second magnetic members are coupled to the outer surface of the rear panel, the pair of second magnetic members being spaced such that a first one of the second magnetic members is located toward the upper end of the rear panel and a second one of the second magnetic members is located toward the lower end of the rear panel;

wherein a hook and loop fastener component is coupled to an outer surface of the rear panel for fastening the rear panel to another hook and loop fastener component mounted on a support;

a plurality of interchangeable signs, each of the signs having a front surface with indicia marked thereon;

wherein the indicia on each of the signs is different from each other, each of the indicia relating to road side emergencies;

wherein all of the signs are adapted to fit in the pocket simultaneously.

* * * * *